US007976133B2

(12) United States Patent
Sugahara

(10) Patent No.: US 7,976,133 B2
(45) **Date of Patent: *Jul. 12, 2011**

(54) LIQUID-JETTING APPARATUS AND METHOD FOR PRODUCING THE SAME

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 299 days.

This patent is subject to a terminal disclaimer.

(21) Appl. No.: 12/108,310

(22) Filed: Apr. 23, 2008

(65) Prior Publication Data

US 2008/0231666 A1 Sep. 25, 2008

Related U.S. Application Data

(62) Division of application No. 11/227,199, filed on Sep. 16, 2005, now Pat. No. 7,438,395.

(30) Foreign Application Priority Data

Sep. 24, 2004 (JP) ..... 2004-277721

(51) Int. Cl.
*B41J 2/045* (2006.01)

(52) U.S. Cl. ..... 347/68

(58) Field of Classification Search ..... None
See application file for complete search history.

(56) References Cited

U.S. PATENT DOCUMENTS 4,504,845 A 3/1985 Kattner et al.
6,109,736 A 8/2000 Miyata et al.
6,190,492 B1 * 2/2001 Byrne et al. ..... 156/273.7
6,378,994 B1 4/2002 Ueda et al.
6,378,996 B1 4/2002 Shimada et al.
6,382,769 B1 5/2002 Silverbrook
6,450,623 B1 9/2002 Watanabe et al.
6,497,477 B1 12/2002 Nakamura et al.
6,547,376 B1 4/2003 Watanabe et al.
6,557,986 B2 5/2003 Watanabe et al.
6,637,870 B2 10/2003 Sakamoto et al.
6,652,062 B2 11/2003 Umeyama et al.
6,652,079 B2 11/2003 Tsuchii et al.

(Continued)

FOREIGN PATENT DOCUMENTS

EP 0993952 A2 4/2000

(Continued)

OTHER PUBLICATIONS

EP Search Report dtd Jan. 30, 2007, EP Appln. 05020933.

(Continued)

*Primary Examiner* — Matthew Luu
*Assistant Examiner* — Justin Seo
(74) *Attorney, Agent, or Firm* — Banner & Witcoff, Ltd.

(57) ABSTRACT

A liquid-jetting apparatus comprises a nozzle plate formed with nozzles, a pressure chamber plate for forming pressure chambers, and a piezoelectric actuator arranged therebetween. A surface of the nozzle plate, which is opposed to the pressure chamber plate, has an insulating property. Wiring sections, which are formed on the surface having the insulating property, are connected to individual electrodes formed on the piezoelectric actuator. Accordingly, the liquid-jetting apparatus and a method for producing the same are provided, in which any wiring member such as FPC is dispensed with to decrease the number of parts, and the production steps are simplified.

6 Claims, 11 Drawing Sheets

U.S. PATENT DOCUMENTS

| | | | |
|---|---|---|---|
| 6,663,226 | B2 | 12/2003 | Min et al. |
| 6,682,180 | B2 | 1/2004 | Sakamoto et al. |
| 6,688,731 | B1 | 2/2004 | Fujii et al. |
| 6,758,554 | B2 | 7/2004 | Kamei et al. |
| 6,783,212 | B2 | 8/2004 | Ikeda et al. |
| 6,899,409 | B2 | 5/2005 | Kusunoki |
| 6,945,637 | B2 | 9/2005 | Okubo |
| 6,959,979 | B2 | 11/2005 | Goin et al. |
| 6,971,738 | B2 | 12/2005 | Sugahara |
| 6,978,543 | B2 | 12/2005 | Sakamoto et al. |
| 6,986,564 | B2 | 1/2006 | Matsuo et al. |
| 7,004,565 | B2 | 2/2006 | Suzuki et al. |
| 7,004,576 | B2 | 2/2006 | Ito |
| 7,033,002 | B2 | 4/2006 | Tanaka |
| 7,052,115 | B2 | 5/2006 | Sekiya |
| 7,121,651 | B2 | 10/2006 | Takahashi et al. |
| 7,156,493 | B2 | 1/2007 | Ishikawa |
| 7,156,504 | B2 | 1/2007 | Akahane |
| 2003/0020787 | A1 | 1/2003 | Nakamura et al. |
| 2003/0063137 | A1 | 4/2003 | Kamei et al. |
| 2003/0112301 | A1 | 6/2003 | Matsuo et al. |
| 2003/0214563 | A1 | 11/2003 | Okubo |
| 2004/0056937 | A1 | 3/2004 | Ito |
| 2004/0113994 | A1 | 6/2004 | Shinkai |
| 2004/0150694 | A1 | 8/2004 | Kim et al. |
| 2005/0190232 | A1 | 9/2005 | Lee et al. |
| 2005/0219286 | A1 | 10/2005 | Nagashima |
| 2006/0066684 | A1 | 3/2006 | Sugahara |
| 2006/0227179 | A1 | 10/2006 | Temple |
| 2006/0249856 | A1 | 11/2006 | Yamada et al. |
| 2007/0007667 | A1 | 1/2007 | Kim |

FOREIGN PATENT DOCUMENTS

| | | | |
|---|---|---|---|
| EP | 1101615 | A1 | 5/2001 |
| EP | 1138496 | A2 | 10/2001 |
| JP | 01-150550 | A | 6/1989 |
| JP | 03-124449 | A | 5/1991 |
| JP | 03-166958 | A | 7/1991 |
| JP | 09-300632 | A | 11/1997 |
| JP | 2000-006398 | A | 1/2000 |
| JP | 2000-158645 | A | 6/2000 |
| JP | 2000-289201 | A | 10/2000 |
| JP | 2001-063045 | A | 3/2001 |
| JP | 2001-253076 | A | 9/2001 |
| JP | 2002-248759 | A | 9/2002 |
| JP | 2002-264336 | A | 9/2002 |
| JP | 2003-159801 | A | 6/2003 |
| JP | 2003-251805 | A | 9/2003 |
| JP | 2004-106395 | A | 4/2004 |
| JP | 2004-136663 | A | 5/2004 |
| JP | 2004-148597 | A | 5/2004 |

OTHER PUBLICATIONS

Notice of Reasons for Rejection dated Dec. 7, 2010 in Japanese Application No. 2005-275211 and partial English translation thereof.

Notice of Reasons for Rejection dated Dec. 7, 2010 in Japanese Application No. 2005-275212 and partial English translation thereof.

Notice of Reasons for Rejection dated Mar. 1, 2011 in Japanese Application No. 2005-275212 and partial English translation thereof.

* cited by examiner

LIQUID-JETTING APPARATUS AND METHOD FOR PRODUCING THE SAME

CROSS REFERENCE TO RELATED APPLICATIONS

This application is a divisional application of prior U.S. application Ser. No. 11/227,199, filed Sep. 16, 2005, which claims priority to Japanese application no. 2004-277721, filed Sep. 24, 2004, the entire contents of which are incorporated herein.

BACKGROUND OF THE INVENTION

1. Field of the Invention

The present invention relates to a liquid-jetting apparatus for jetting a liquid, and a method for producing the same.

2. Description of the Related Art

A liquid-jetting apparatus for jetting a liquid is known, comprising, for example, nozzles which jet the liquid, pressure chambers which are communicated with the nozzles, and an actuator which changes the volume of the pressure chamber, wherein the actuator is operated to apply the pressure to the liquid contained in the pressure chamber so that the liquid is jetted from the nozzle. In particular, for example, Japanese Patent Application Laid-open No. 2004-136663 describes an ink-jet head which jets the ink from nozzles. The ink-jet head has an actuator comprising a plurality of piezoelectric sheets which are provided to cover a plurality of pressure chambers, a plurality of individual electrodes which are formed on an upper layer of the piezoelectric sheet disposed at the uppermost layer and which are opposed to the plurality of pressure chambers respectively, and a common electrode which is formed on a lower layer of the piezoelectric sheet disposed at the uppermost layer. The plurality of individual electrodes, which are formed on the upper surface of the piezoelectric sheet, are electrically connected to a flexible printed circuit board (FPC) by means of solder or the like at the lands. Further, FPC is connected to a driver IC (driving unit). When the driving voltage is selectively applied to the plurality of individual electrodes from the driver IC via FPC, then the portion of the piezoelectric sheet, which is interposed between the individual electrode and the common electrode, is deformed, and thus the pressure is applied to the ink contained in the pressure chamber.

In the case of the ink-jet head described in Japanese Patent Application Laid-open No. 2004-136663, any wiring member such as FPC is required to electrically connect the plurality of individual electrodes and the driver IC. Therefore, the production cost is expensive corresponding thereto. In recent years, it has been tried to arrange a plurality of pressure chambers at a higher density in order to satisfy both of the requests for the improvement in the image quality and the miniaturization of the ink-jet head. However, if a plurality of pressure chambers are arranged at a high density, it is necessary that a plurality of individual electrodes, which are opposed to the plurality of pressure chambers respectively, should be also arranged at a high density. However, it is extremely difficult to connect, with the solder or the like, FPC and the lands of the plurality of individual electrodes which are arranged crowdedly respectively. The connecting structure tends to be complicated in order to enhance the reliability of the electric connection, and the production steps are complicated. Therefore, such an arrangement is disadvantageous in view of the production cost.

SUMMARY OF THE INVENTION

An object of the present invention is to provide a liquid-jetting apparatus and simplify the production steps, and a method for producing the same, which make it possible to dispense with any wiring member such as FPC, reduce the number of parts.

According to a first aspect of the present invention, there is provided a liquid-jetting apparatus comprising a plurality of liquid flow passages which include a plurality of nozzles for jetting a liquid and a plurality of pressure chambers respectively communicated with the plurality of nozzles respectively; and an actuator which selectively changes volumes of the plurality of pressure chambers; wherein the liquid flow passages are formed by a plurality of stacked plates; the actuator is arranged between a pressure chamber plate which is included in the plurality of plates and which forms the plurality of pressure chambers and a nozzle plate which has an insulating property at least on a surface opposed to the pressure chamber plate and which is formed with the nozzles; the actuator includes a vibration plate which covers the plurality of pressure chambers, a piezoelectric layer which is provided on a surface of the vibration plate disposed on a side opposite to the plurality of pressure chambers, and a plurality of individual electrodes which are formed at positions opposed to the plurality of pressure chambers respectively on a surface of the piezoelectric layer disposed on a side opposite to the vibration plate; and a plurality of wiring sections, which are connected to the plurality of individual electrodes respectively, are formed on the surface of the nozzle plate disposed on a side of the actuator.

The liquid-jetting apparatus is constructed such that the pressure is applied to the liquid contained in the pressure chambers to jet the liquid from the nozzles by selectively changing the volumes of the plurality of pressure chambers by using the actuator. In this arrangement, the plurality of liquid flow passages are formed by the plurality of plates. The actuator is arranged between the nozzle plate composed of the insulating material and the pressure chamber plate included in the plurality of plates. The plurality of wiring sections, which are connected to the plurality of individual electrodes of the actuator respectively, are formed on the surface of the nozzle plate disposed on the side of the actuator. As described above, the plurality of wiring sections, which are connected to the plurality of individual electrodes, are formed on the nozzle plate composed of the insulating material. Therefore, the nozzle plate is allowed to have the function of the conventional wiring member such as FPC, and it is possible to omit or dispense with the wiring member. Thus, it is possible to decrease the number of parts, and it is possible to reduce the production cost of the liquid-jetting apparatus. The driving unit can be arranged on the nozzle plate as well. Further, the nozzle plate can be adhered to the actuator, simultaneously with which the plurality of individual electrodes can be electrically connected to the plurality of wiring sections. Thus, it is possible to simplify the production steps.

In the liquid-jetting apparatus of the present invention, the liquid flow passages may be formed to penetrate through the actuator. In this arrangement, it is possible to arrange the actuator between the pressure chamber plate and the nozzle plate.

In the liquid-jetting apparatus of the present invention, through-holes, which constitute parts of the liquid flow passages, may be formed through the piezoelectric layer, and protective films, which prevent the liquid from being permeated into the piezoelectric layer, may be formed on surfaces which define the through-holes. Owing to the protective films, it is possible to avoid the permeation of the liquid into the piezoelectric layer. In particular, when the liquid has conductivity, it is possible to avoid the short circuit formation between the individual electrodes which would be otherwise caused by the conductive liquid.

In the liquid-jetting apparatus of the present invention, the nozzle plate may be formed of an insulating material having flexibility. Therefore, the nozzle plate can be subjected to the flexible arrangement equivalently, for example, to FPC having the flexibility. It is possible to enhance the degree of freedom of the arrangement of the driving unit or the like connected to the wiring section.

In the liquid-jetting apparatus of the present invention, a plurality of recesses may be formed at portions of the nozzle plate opposed to the plurality of individual electrodes respectively. Therefore, when the driving voltage is supplied to the individual electrode to deform the piezoelectric layer, the deformation of the piezoelectric layer is not inhibited by the nozzle plate and the adhesive for adhering the nozzle plate and the piezoelectric layer. The driving efficiency of the actuator is improved.

In the liquid-jetting apparatus of the present invention, a plurality of recesses may be formed at portions of the vibration plate opposed to the plurality of individual electrodes respectively. Therefore, when the piezoelectric layer is formed to have a uniform thickness on the surface of the vibration plate on which the recesses are formed, the recesses corresponding to the recesses of the vibration plate are formed at the portions of the piezoelectric layer at which the individual electrodes are formed. Accordingly, even when the driving voltage is supplied to the individual electrode to deform the piezoelectric layer, the deformation of the piezoelectric layer is not inhibited by the nozzle plate. The driving efficiency of the actuator is improved.

In the liquid-jetting apparatus of the present invention, the nozzle plate and the piezoelectric layer may be adhered to one another by an anisotropic conductive material which has conductivity in a compressed state. In this arrangement, the anisotropic conductive material can be used to simultaneously perform the adhesion of the piezoelectric layer and the nozzle plate and the electric connection of the individual electrodes and the wiring sections. It is possible to simplify the production steps.

In the liquid-jetting apparatus of the present invention, the anisotropic conductive material may be compressed to have the conductivity in connection areas between contact sections of the individual electrodes and terminal sections of the wiring sections, and the anisotropic conductive material may have no conductivity in areas other than the connection areas. The anisotropic conductive material has the conductivity at the electric connecting portions between the contact sections of the individual electrodes and the terminal sections of the wiring sections, but the anisotropic conductive material does not have the conductivity at the portions other than the above. Therefore, when the driving voltage is applied to the wiring section, it is possible to maximally suppress the generation of any unnecessary capacitance in the piezoelectric layer due to the portion other than the terminal section of the wiring section. The driving efficiency of the actuator is improved.

In the liquid-jetting apparatus of the present invention, a spacing distance between the contact sections of the individual electrodes and the terminal sections of the wiring sections may be smaller than a spacing distance between the nozzle plate and the piezoelectric layer at portions other than the contact sections of the individual electrodes and the terminal sections of the wiring sections. In this arrangement, only the anisotropic conductive material, which is disposed between the individual electrodes and the wiring sections, is compressed, and thus it is easy to electrically connect them.

In the liquid-jetting apparatus of the present invention, the plurality of wiring sections may be formed in areas in which the plurality of wiring sections are not opposed to the plurality of nozzles and the plurality of pressure chambers, on the surface of the nozzle plate disposed on the side of the actuator. The wiring sections are formed in the areas not opposed to the nozzles. Therefore, the liquid is not adhered to the wiring sections. In particular, when the liquid has any conductivity, it is possible to avoid the short circuit formation between the wiring sections. Further, the wiring sections do not inhibit the deformation of the piezoelectric layer during the jetting of the liquid as well, because the wiring sections are formed in the areas not opposed to the pressure chambers.

The liquid-jetting apparatus of the present invention may further comprise a common liquid chamber which is communicated with the plurality of pressure chambers; wherein the common liquid chamber may be arranged on a side opposite to the nozzles with respect to the actuator. The arrangement space for the nozzles can be secured to be wide, because the common liquid chamber is arranged on the side opposite to the nozzles as described above. Therefore, the degree of freedom of the arrangement is enhanced. It is possible to arrange the nozzles at a higher density.

In the liquid-jetting apparatus of the present invention, the nozzles may be directed downwardly, and the common liquid chamber may be arranged at an upper position than the nozzles. In this arrangement, any bubble, with which the liquid flow passage is contaminated, can be discharged toward the common liquid chamber with ease.

In the liquid-jetting apparatus of the present invention, the plurality of pressure chambers may be formed between the actuator and the common liquid chamber. In this arrangement, the space for arranging the common liquid chamber can be secured to be wide, because the common liquid chamber is formed over the pressure chambers.

In the liquid-jetting apparatus of the present invention, individual liquid flow passages, which are communicated with the nozzles via the plurality of pressure chambers from the common liquid chamber, may be formed, and portions of the individual liquid flow passages, which are disposed nearer to the common liquid chamber, may be arranged while being inclined to extend upwardly. In this arrangement, any bubble, with which the liquid flow passage is contaminated, is reliably discharged toward the common liquid chamber without staying in the pressure chamber, because the individual liquid flow passages, which are formed in the pressure chambers, extend vertically upwardly at portions disposed on the more upstream side along with the flow of the liquid.

In the liquid-jetting apparatus of the present invention, the insulating material having the flexibility may be polyimide. Polyimide is not only an insulating material having flexibility, but polyimide is also liquid-repellent. Therefore, the liquid flows smoothly on the surface of the nozzle plate.

In the liquid-jetting apparatus of the present invention, the liquid-jetting apparatus may be an ink-jet head. In this arrangement, the plurality of individual electrodes are not electrically connected with the solder or the like with respect to any wiring member such as FPC. Therefore, it is possible to arrange the individual electrodes at a high density.

An ink-jet printer according to the present invention may comprise the liquid-jetting apparatus according to the present invention. In this arrangement, any wiring member such as FPC is not used for the wiring arrangement for connecting the individual electrodes of the ink-jet head and IC for driving the piezoelectric actuator. Therefore, the reliability is high for the electric connection therebetween.

A liquid-jetting apparatus-producing method according to the present invention resides in a method for producing the liquid-jetting apparatus as described above; the method comprising a wiring section-forming step of forming the wiring sections on the surface of the nozzle plate to be adhered to the piezoelectric layer; and an adhering step of adhering the nozzle plate to the actuator; wherein terminal sections of the wiring sections are adhered to contact sections of the individual electrodes in a conducting state in the adhering step, and portions of the nozzle plate other than the terminal sections are adhered to the piezoelectric layer in an insulating state. In this procedure, it is possible to simultaneously perform the adhesion of the nozzle plate and the actuator and the electric connection of the individual electrodes on the side of the actuator and the wiring sections on the side of the nozzle plate. It is possible to simplify the production steps. Further, it is possible to maximally suppress the generation of any unnecessary capacitance in the piezoelectric layer by adhering the portions of the wiring sections other than the terminal sections to the piezoelectric layer in the insulating state. The driving efficiency of the actuator is improved.

The method for producing the liquid-jetting apparatus of the present invention may further comprise a sticking step of sticking an anisotropic conductive material to an adhering surface of the piezoelectric layer or the nozzle plate before the adhering step; wherein one of surfaces of the contact section of the individual electrode and the terminal section of the wiring section may be allowed to make contact with the anisotropic conductive material adhered to the other of the surfaces of the contact section of the individual electrode and the terminal section of the wiring section in the adhering step, and the anisotropic conductive material disposed on the concerning portion may be compressed to connect the individual electrode and the wiring section in the conducting state, while the nozzle plate may be adhered to the piezoelectric layer by the anisotropic conductive material disposed on the other portions. In this procedure, one type of the anisotropic conductive material can be used to simultaneously perform the adhesion of the nozzle plate and the actuator and the electric connection of the individual electrodes and the wiring sections. Therefore, it is possible to decrease the number of types of adhesives to be used, and it is possible to reduce the production cost.

The method for producing the liquid-jetting apparatus of the present invention may further comprise, before the adhering step, a hole-forming step of forming holes through the vibration plate, the holes constructing parts of the liquid flow passages, and a piezoelectric layer-forming step of forming the piezoelectric layer in only an area of the vibration plate in which the holes are not formed, by depositing particles of a piezoelectric material on a surface of the vibration plate disposed on a side opposite to the pressure chambers. In this manner, the piezoelectric layer is formed only in the area in which no hole is formed, by depositing the particles of the piezoelectric material on the vibration plate after forming the through-holes through the vibration plate. Therefore, the through-holes can be formed through the piezoelectric layer simultaneously with the formation of the piezoelectric layer.

The method for producing the liquid-jetting apparatus of the present invention may further comprise, in the piezoelectric layer-forming step, a protective film-forming step of forming protective films on surfaces which define through-holes formed at positions on the piezoelectric layer corresponding to the holes of the vibration plate, for constructing parts of the liquid flow passages so that the liquid is prevented from being permeated into the piezoelectric layer. In this procedure, the protective films can be used to prevent the liquid from being permeated into the piezoelectric layer through the surfaces which define the through-holes. In particular, when the liquid is conductive, it is possible to avoid the short circuit formation which would be otherwise caused between the individual electrodes by the conductive liquid.

BRIEF DESCRIPTION OF THE DRAWINGS

FIG. 8 shows steps of stacking a plurality of plates other than a nozzle plate 14, wherein

FIG. 9 shows steps of forming the nozzle plate, wherein

DESCRIPTION OF THE PREFERRED EMBODIMENTS

Figure 1:
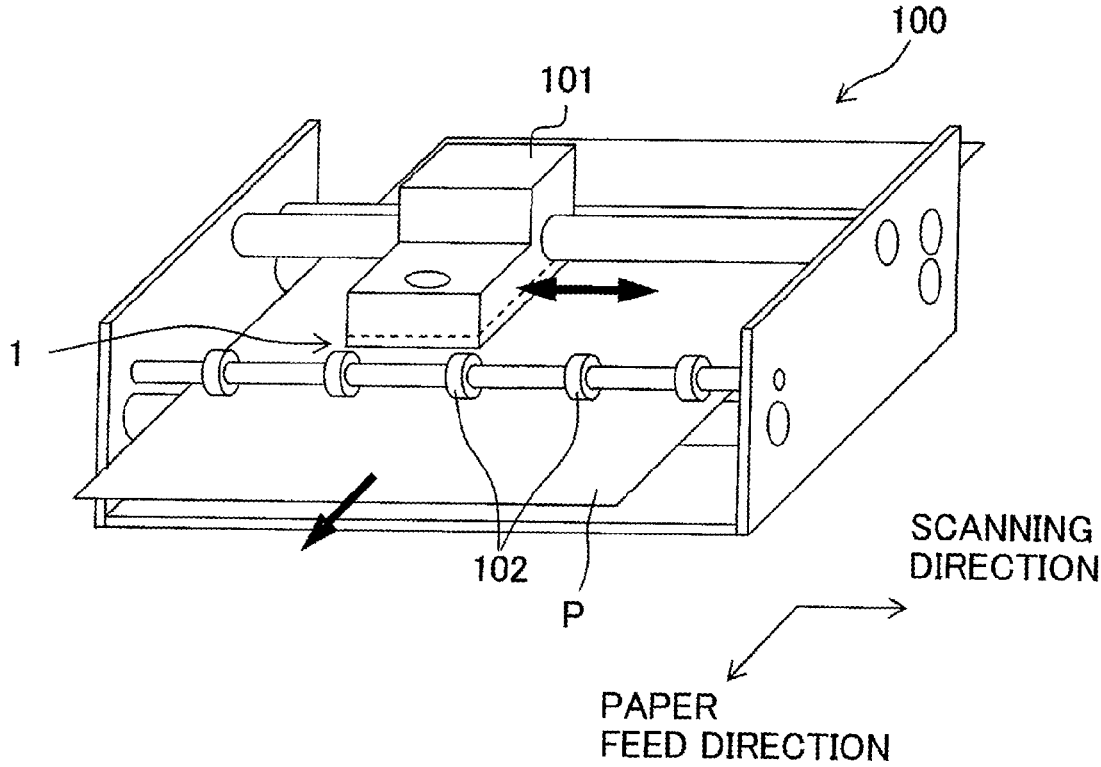
FIG. 1 shows a schematic perspective view illustrating an ink-jet printer according to an embodiment of the present invention.

An embodiment of the present invention will be explained. This embodiment is illustrative of a case in which the present invention is applied to an ink-jet head for jetting the ink from nozzles. At first, a brief explanation will be made about an ink-jet printer 100 provided with the ink-jet head 1. As shown in FIG. 1, the ink-jet printer 100 principally comprises a carriage 101 which is movable in the left and right directions as shown in FIG. 1, the ink-jet head 1 of the serial type which is provided on the carriage 101 and which jets the ink onto the recording paper P, and a transport roller 102 which transports the recording paper P in the frontward direction as shown in FIG. 1. The ink-jet head 1 is moved in the left and right directions (scanning directions) as shown in FIG. 1 integrally with the carriage 101 to jet the ink onto the recording paper P from jetting ports of nozzles 20 (see FIGS. 2 to 7) formed on the ink-jetting surface of the lower surface thereof. The recording paper P, which has been subjected to the recording by the ink-jet head 1, is discharged frontwardly (in the paper feed direction) by the transport roller 102.

Next, an explanation will be made with reference to FIGS. 2 to 7 about the ink-jet head 1. The ink-jet head 1 is constructed by a plurality of stacked plates. The ink-jet head 1 comprises a plurality of individual ink flow passages 2 including a plurality of nozzles 20 which jet the ink and a plurality of pressure chambers 16 which are communicated with the plurality of nozzles 20 respectively, and a piezoelectric actuator 3 which selectively changes the volumes of the plurality of pressure chambers 16.

Figure 3:
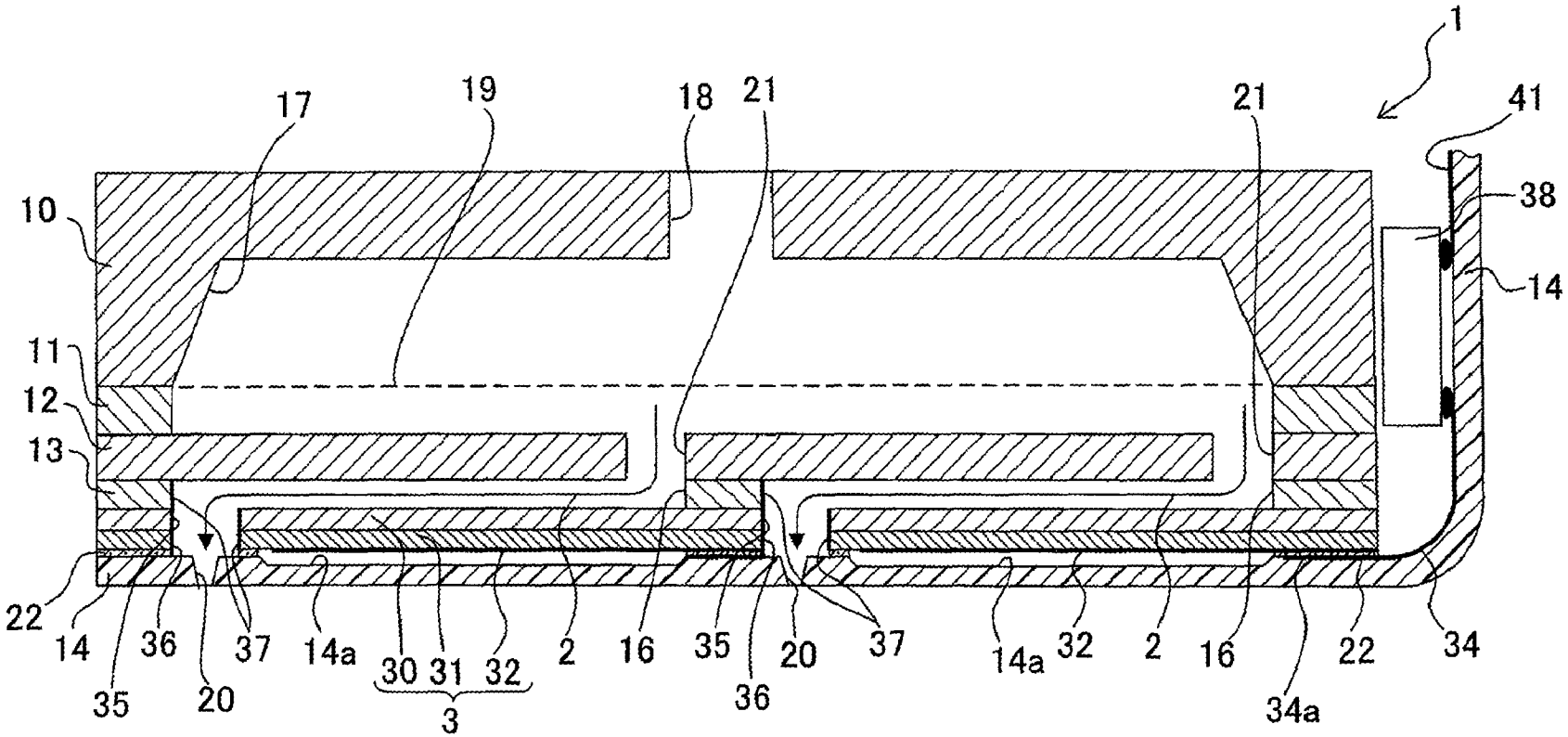
FIG. 3 shows a sectional view taken along a line III-III shown in FIG. 2.

As shown in FIG. 3, the plurality of individual ink flow passages 2 are formed by a plurality of plates including a piezoelectric layer 31 and a vibration plate 30 of the piezoelectric actuator 3. The plurality of plates are stacked from the upper position in an order of manifold plates 10, 11, a base plate 12, a pressure chamber plate 13, the vibration plate 30 and the piezoelectric layer 31 of the piezoelectric actuator 3, and a nozzle plate 14. Each of the manifold plates 10, 11, the base plate 12, and the pressure chamber plate 13 is a metal plate composed of stainless steel or the like. The ink flow passages, which include, for example, a manifold 17 and pressure chambers 16 as described later on, can be formed with ease by means of the etching. On the other hand, the nozzle plate 14 is formed of a flexible synthetic resin material, for example, a high polymer synthetic resin material such as polyimide.

Figure 2:
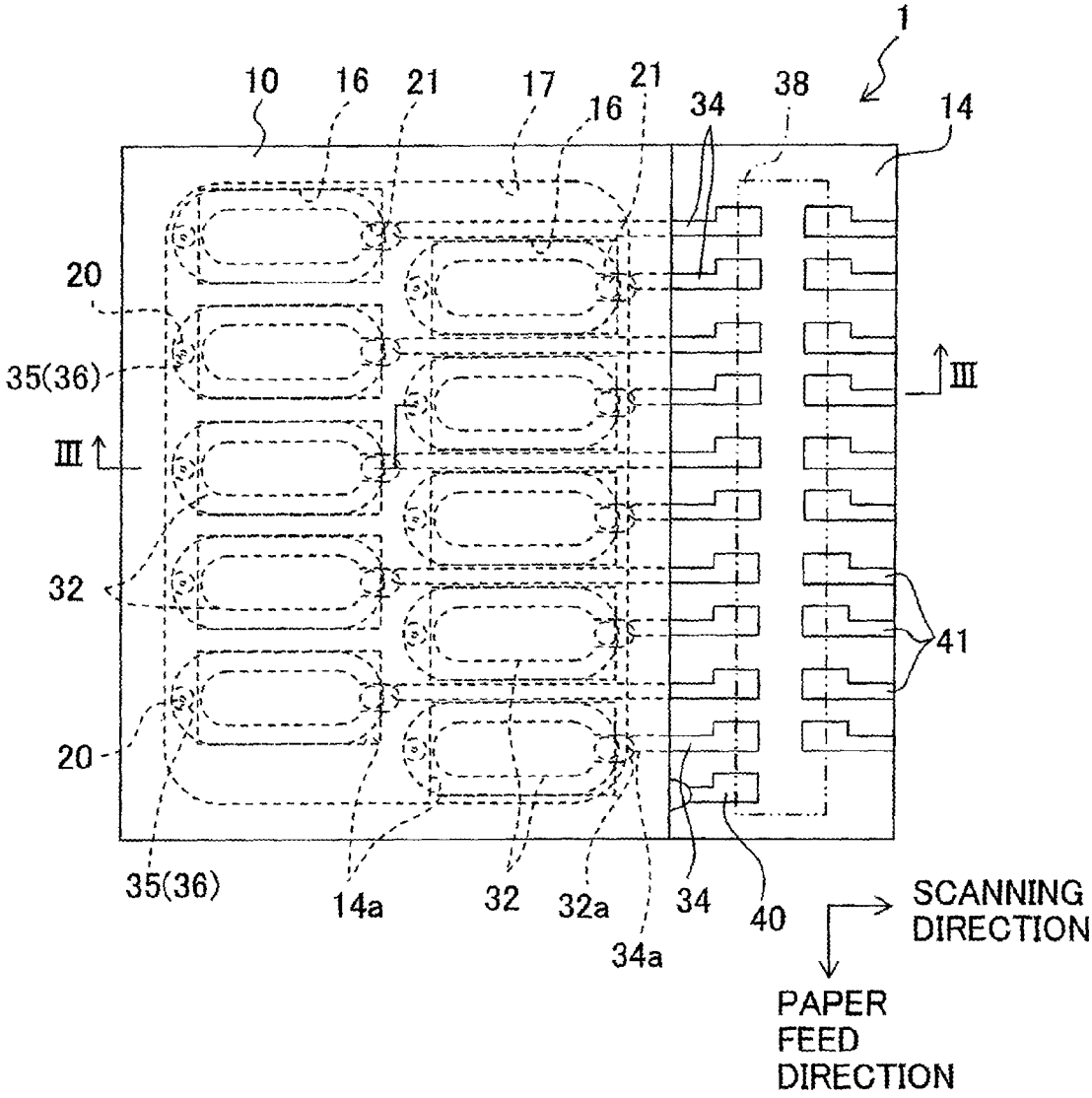
FIG. 2 shows a plan view illustrating an ink-jet head.

At first, an explanation will be made successively about the plates other than the piezoelectric actuator 3. The manifold 17, which is continued to the plurality of pressure chambers 16, is formed in the two manifold plates 10, 11. As shown in FIGS. 2 and 3, the manifold 17 is formed so that the manifold 17 is overlapped with all of the plurality of pressure chambers 16 as viewed in a plan view. The ink is supplied to the manifold 17 from an unillustrated ink supply source via an ink supply hole 18. A filter 19, which removes any dust or the like mixed with the ink in the manifold 17, is provided between the two manifold plates 10, 11. The base plate 12 is formed with a plurality of communication holes 21 which make communication between the manifold 17 and the plurality of pressure chambers 16 respectively.

The pressure chamber plate 13 is formed with a plurality of pressure chambers 16 which are arranged along a flat surface as shown in FIG. 2. The plurality of pressure chambers 16 are arranged in two arrays in the paper feed direction (vertical direction as shown in FIG. 2). Each of the pressure chambers 16 is formed to be substantially elliptical as viewed in a plan view. The pressure chambers 16 are arranged so that the major axis direction thereof resides in the left and right directions (scanning direction). The respective pressure chambers 16 are communicated with the manifold 17 via the communication holes 21 formed in the base plate 12 at the rightward ends as shown in FIG. 2.

Figure 4:
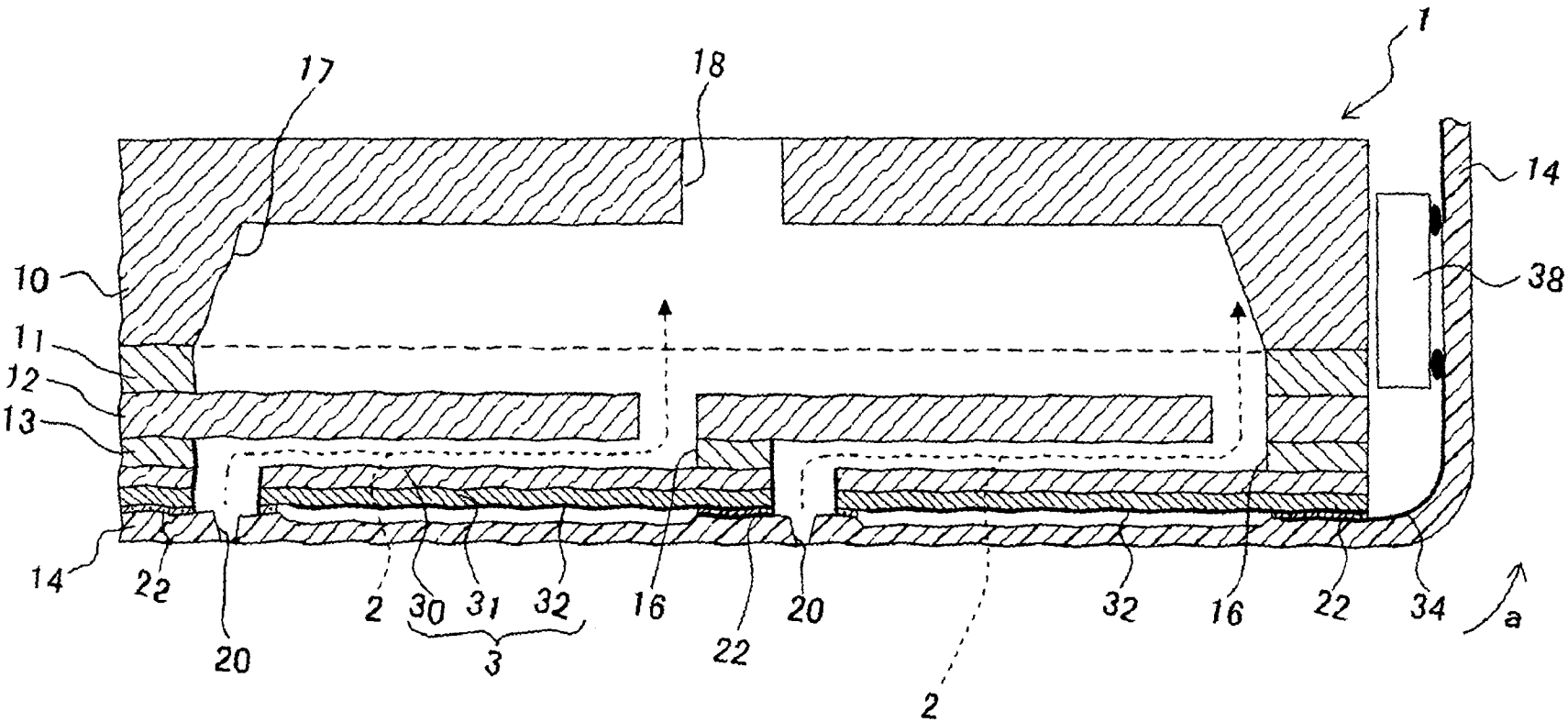
FIG. 4 shows a sectional view illustrating the ink-jet head arranged in an inclined state, corresponding to FIG. 3.
Figure 5:
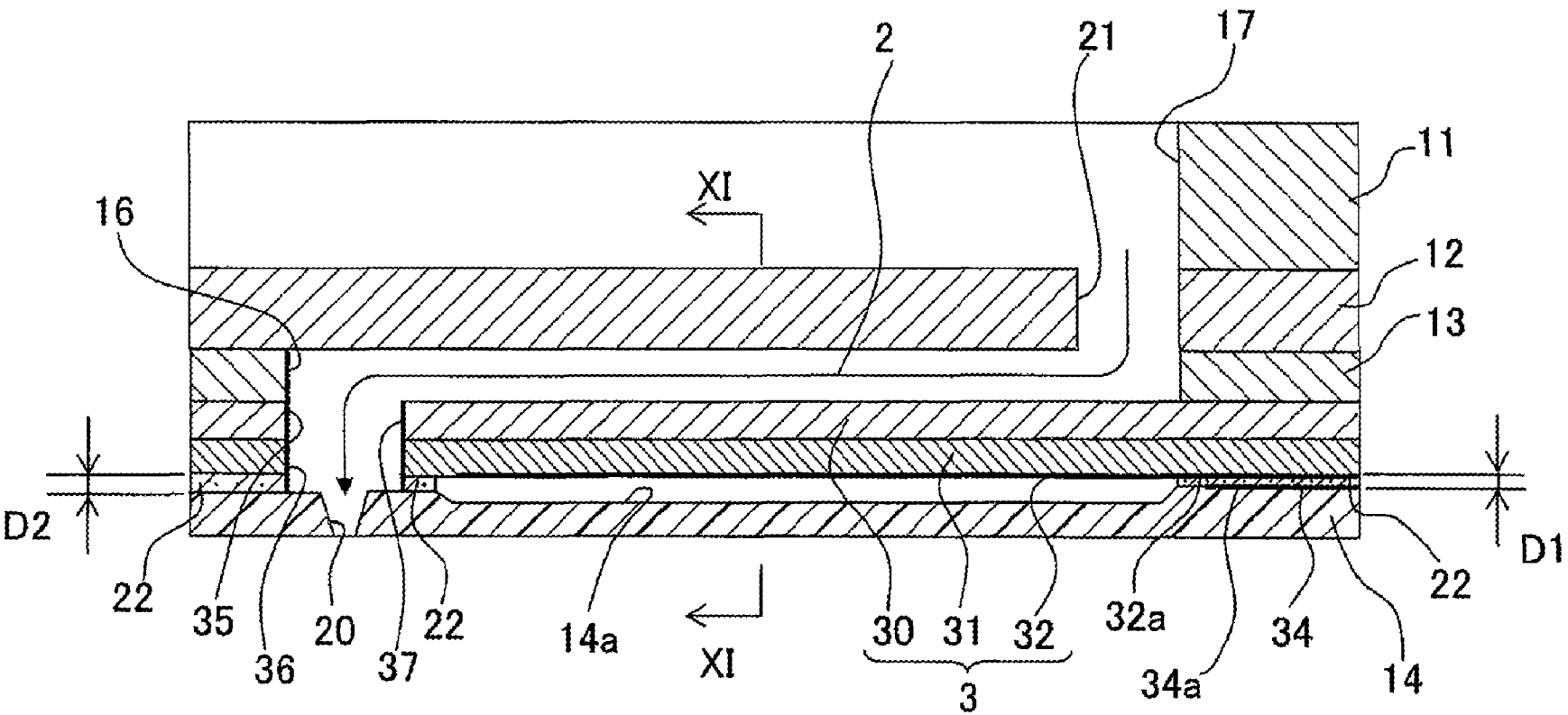
FIG. 5 shows a partial magnified view illustrating those shown in FIG. 4.
Figure 6:
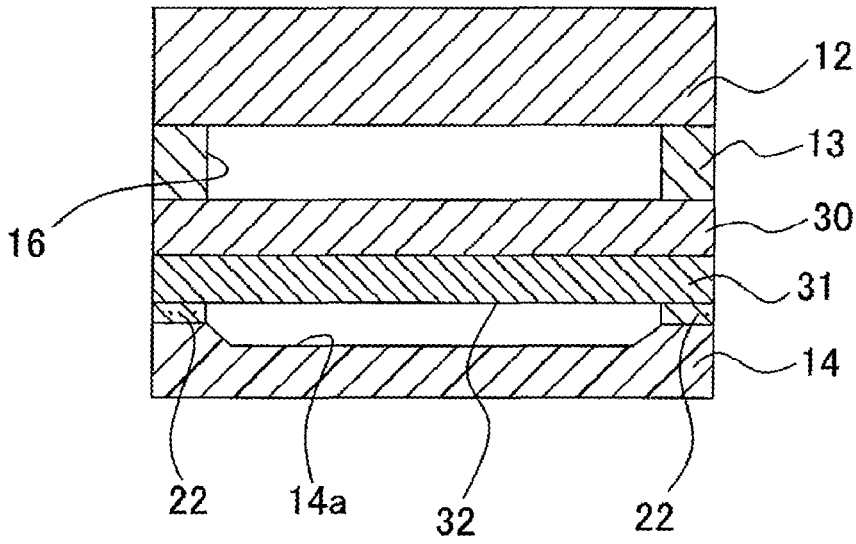
FIG. 6 shows a sectional view taken along a line VI-VI shown in FIG. 5.
Figure 7:
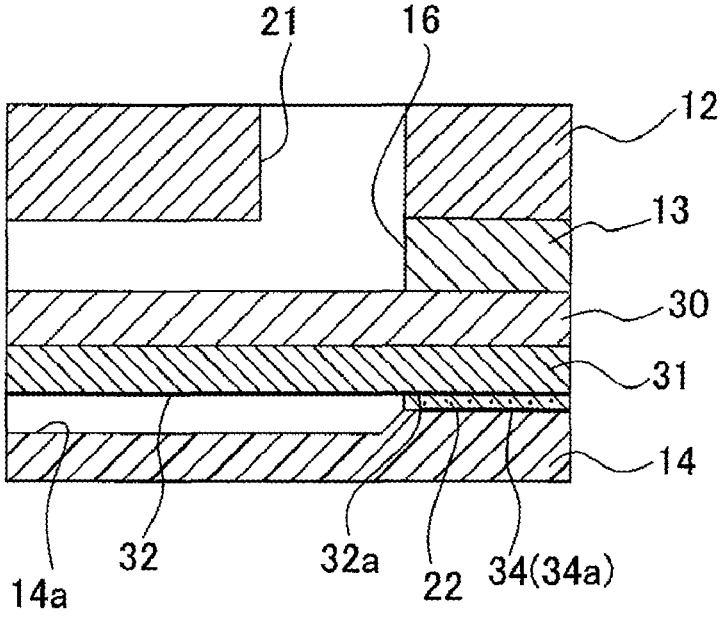
FIG. 7 shows a magnified view illustrating major parts shown in FIG. 5.

A plurality of nozzles 20, which are directed downwardly in the vertical direction, are formed at positions of the nozzle plate 14 respectively at which the leftward ends of the plurality of pressure chambers 16 shown in FIG. 2 are overlapped as shown in a plan view. As shown in FIGS. 3 to 5, the nozzle plate 14 is adhered to the surface of the piezoelectric actuator 3 on the side opposite to the pressure chambers 16 by an adhesive 22 which is composed of an anisotropic conductive material that has the conductivity in a compressed state. The piezoelectric actuator 3 is arranged between the pressure chamber plate 13 and the nozzle plate 14. The manifold 17 and the pressure chambers 16 are arranged on the side mutually opposite to the nozzles 20 with the piezoelectric actuator 3 intervening therebetween. As described above, the manifold 17 is arranged on the side opposite to the nozzles 20 in relation to the piezoelectric actuator 3. Therefore, the area, in which the nozzles 20 can be arranged, is widened to enhance the degree of freedom of the arrangement. It is possible to arrange the nozzles 20 at a higher density. The nozzles 20 are directed downwardly in the vertical direction. The manifold 17 is arranged at the upper position in the vertical direction as compared with the nozzles 20. Therefore, any bubble, with which the individual ink flow passage 2 is contaminated, is easily moved to the manifold 17 in accordance with the buoyancy of itself. It is easy to discharge the bubble toward the manifold 17. Further, as shown in FIG. 4, when the ink-jet head 1 is arranged while being slightly inclined in the direction of the arrow "a" with respect to the surface (horizontal surface) on which the ink-jet printer 100 is installed, and the nozzles 20 are directed obliquely downwardly, then the bubbles contained in the individual ink flow passage 2 tend to be moved to the manifold 17 more promptly as indicated by broken line arrows.

When the manifold 17 is arranged at the upper position in the vertical direction as compared with the nozzles 20 as described above, the bubble, with which the individual ink flow passage 2 is contaminated, is easily moved to the manifold 17 by the aid of the buoyancy thereof. In particular, as shown in FIG. 4, when the portions of the individual ink flow passages 2, which are disposed on the more upstream side along with the flow of the ink, are formed to extend upwardly in the vertical direction, the bubble, with which the individual ink flow passage 2 is contaminated, can be moved to the manifold 17 more reliably. That is, when the ink-jet head 1 is arranged while being inclined with respect to the horizontal plane, the bubble, with which the individual ink flow passage 2 is contaminated, can be moved to the manifold 17 more reliably.

The pressure chambers 16 formed in the pressure chamber plate 13 are communicated with the nozzles 20 formed in the nozzle plate 14 via through-holes 35, 36 formed through the vibration plate 30 and the piezoelectric layer 31 of the piezoelectric actuator 3 respectively. A plurality of wiring sections 34, which are connected to a plurality of individual electrodes 32 respectively and which extend in one of the scanning directions (rightward direction as shown in FIG. 2), are formed on the surface of the nozzle plate 14 on the side of the piezoelectric actuator 3. Further, a driver IC 38, which is connected to the plurality of wiring sections 34, is arranged on the surface of the nozzle plate 14 on which the plurality of wiring sections 34 are formed. The wiring sections 34 and the driver IC 38 will be explained in detail later on. As shown in FIGS. 3 and 5, the individual ink flow passages 2, which extend from the manifold 17 via the pressure chambers 16 and which penetrate through the piezoelectric actuator 3 to arrive at the nozzles 20, are formed in the ink-jet head 1.

Next, the piezoelectric actuator 3 will be explained. As shown in FIGS. 2 to 7, the piezoelectric actuator 3 includes the vibration plate 30 which covers the lower portions of the plurality of pressure chambers 16, the piezoelectric layer 31 which is formed on the surface of the vibration plate 30 on the side opposite to the plurality of pressure chambers 16, and the plurality of individual electrodes 32 which are formed at the positions opposed to the plurality of pressure chambers 16 respectively on the surface of the piezoelectric layer 31 disposed on the side opposite to the vibration plate 30.

The vibration plate 30 is a metal plate which is substantially rectangular as viewed in a plan view. The vibration plate 30 is composed of, for example, iron-based alloy such as stainless steel, copper-based alloy, nickel-based alloy, or titanium-based alloy. The vibration plate 30 is joined to the lower surface of the pressure chamber plate 13 so that the plurality of pressure chambers 16 are closed thereby. The vibration plate 30 also serves as a common electrode which is opposed to the plurality of individual electrodes 32 and which allows the electric field to act on the piezoelectric layer 31 between the individual electrodes 32 and the vibration plate 30. The vibration plate 30 is retained at the ground electric potential by the aid of the wiring sections 40 (see FIG. 2). The piezoelectric layer 31 is formed on the lower surface of the vibration plate 30. The piezoelectric layer 31 contains a major component of lead zirconate titanate (PZT) which is a ferroelectric substance and which is a solid solution of lead titanate and lead zirconate. The piezoelectric layer 31 is formed continuously to extend over the plurality of pressure chambers 16.

The through-holes 35, 36, which constitute parts of the individual ink flow passages 2 respectively, are formed at the positions of the vibration plate 30 and the piezoelectric layer 31 overlapped with the leftward ends of the pressure chambers 16 as viewed in a plan view as shown in FIG. 2. The individual ink flow passages 2 penetrate through the piezoelectric actuator 3 at the through-holes 35, 35 to make communication between the pressure chambers 16 and the nozzles 20. In such an arrangement, if the piezoelectric layer 31 is exposed to the individual ink flow passages 2 at the through-holes 36, there is such a possibility that the ink having conductivity may be permeated into the piezoelectric layer 31, and any short circuit may be formed by the ink between the plurality of individual electrodes 32. Accordingly, the ink-jet head of the embodiment of the present invention has protective films 37 which are formed on the surfaces which define the through-holes 35, 36 in order to avoid the permeation, into the piezoelectric layer 31, of the ink flowing through the individual ink flow passages 2. The protective film 37 is composed of, for example, silicon oxide or silicon nitride.

The plurality of individual electrodes 32, each of which has an elliptical planar shape slightly smaller than the pressure chamber 16 as a whole, are formed on the lower surface of the piezoelectric layer 31. The plurality of individual electrodes 32 are formed at the positions at which they are overlapped with the central portions of the corresponding pressure chambers 16 respectively as viewed in a plan view. The individual electrode 32 is composed of a conductive material such as gold. As shown in FIGS. 2 to 5 and 7, a plurality of contact sections 32*a*, which are electrically connected to the driver IC 38 via the plurality of wiring sections 34 formed on the nozzle plate 14 respectively, extend from the ends of the plurality of individual electrodes 32 in the longitudinal direction (rightward ends as shown in FIGS. 2 to 5 and 7) to areas in which the contact sections 32*a* are not overlapped with the pressure chambers 16 as viewed in a plan view. The driving voltage is selectively applied to the plurality of individual electrodes 32 from the driver IC 38 via the plurality of wiring sections 34 and the contact sections 32*a*.

Next, an explanation will be made about the function of the piezoelectric actuator 3. When the driving voltage is selectively applied from the driver IC 38 to the plurality of individual electrodes 32, a state is given, in which the electric potential differs between the individual electrode 32 disposed on the upper side of the piezoelectric layer 31 supplied with the driving voltage and the vibration plate 30 as the common electrode disposed on the lower side of the piezoelectric layer 31 retained at the ground electric potential. The electric field in the vertical direction is generated in the portion of the piezoelectric layer 31 interposed between the individual electrode 32 and the vibration plate 30. Accordingly, the portion of the piezoelectric layer 31, which is disposed just under the individual electrode 32 applied with the driving voltage, is shrunk in the horizontal direction which is perpendicular to the vertical direction as the polarization direction. In this situation, the vibration plate 30 is deformed so that the vibration plate 30 is convex toward the pressure chamber 16 in accordance with the shrinkage of the piezoelectric layer 31. Therefore, the volume in the pressure chamber 16 is decreased, and the pressure is applied to the ink contained in the pressure chamber 16. Thus, the ink is jetted from the nozzle 20 communicated with the pressure chamber 16.

The nozzle plate 14 is formed of the insulating material having the flexibility. As shown in FIGS. 2 to 5 and 7, the plurality of wiring sections 34*a*, which has the terminal sections 34*a*, which are connected to the contact sections 32*a* of the plurality of individual electrodes 32 respectively at the ends (leftward ends as shown in FIG. 2) on the surface of the nozzle plate 14 disposed on the side of the piezoelectric actuator 3, and which extend in one direction of the scanning directions (rightward direction as shown in FIG. 2), are formed. The ends of the plurality of wiring sections 34, which are disposed on the side opposite to the individual electrodes 32, are connected to the driver IC 38. The driver IC 38 is arranged on the nozzle plate 14. As described above, the plurality of individual electrodes 32 and the driver IC 38 are electrically connected to one another by the aid of the plurality of wiring sections 34 which are formed on the nozzle plate 14. Therefore, any wiring member such as FPC, which has been hitherto required, is unnecessary. It is possible to decrease the number of parts, and it is possible to reduce the production cost of the ink-jet head 1. Further, the nozzle plate 14 is formed of the insulating material having the flexibility. Therefore, the nozzle plate 14 can be subjected to the flexible arrangement as shown in FIGS. 3 and 4, in the same manner as the flexible wiring member such as FPC having been hitherto used. Thus, it is possible to enhance the degree of freedom of the arrangement of the driver IC 38 or the like.

As shown in FIG. 2, a wiring section 40 is formed on the surface of the nozzle plate 14 on which the plurality of wiring sections 34 are formed in order that the vibration plate 30 as the common electrode is retained at the ground electric potential by the aid of the driver IC 38. Further, as shown in FIGS. 2 and 3, a plurality of wiring sections 41, which connect the driver IC 38 and a control unit (not shown) of the ink-jet printer 100, are also formed on the nozzle plate 14.

In this arrangement, the nozzle plate 14 is adhered by the adhesive 22 composed of an anisotropic conductive film (ACF) or an anisotropic conductive paste (ACP). The anisotropic conductive material is obtained, for example, by dispersing conductive particles in a thermosetting epoxy resin. The anisotropic conductive material has an insulating property in an uncompressed state, and it has a conductive property in a compressed state. The adhesive 22 is compressed to have the conductivity in the connection area between the contact sections 32*a* of the individual electrodes 32 and the terminal sections 34*a* of the wiring sections 34, in which the contact sections 32*a* and the terminal sections 34*a* are electrically connected to one another by the adhesive 22. However, the adhesive 22 is not compressed to have the insulating property in the portions other than the electric connecting portions between the contact sections 32*a* and the terminal sections 34*a*. Therefore, it is possible to suppress the generation of any unnecessary capacitance in the piezoelectric layer 32 interposed between the wiring section 34 and the vibration plate 30 at the portion other than the electric connecting portion between the contact section 32*a* and the terminal section 34*a*. Accordingly, the driving efficiency of the piezoelectric actuator 3 is improved.

As shown in FIG. 5, the spacing distance (D1 shown in FIG. 5) between the contact section 32*a* of the individual electrode 32 and the terminal section 34*a* of the wiring section 34 formed on the nozzle plate 14 is smaller than the spacing distance (D2 shown in FIG. 5) between the nozzle plate 14 and the piezoelectric layer 31 at any portion other than the above. Therefore, when the nozzle plate 14 is pressed against the piezoelectric layer 31 to adhere the nozzle plate 14 and the piezoelectric layer 31 to one another, it is easy that only the adhesive 22, which is disposed between the contact sections 32*a* of the individual electrodes 32 and the terminal sections 34*a* of the wiring sections 34, is compressed to electrically connect the individual electrodes 32 and the wiring sections 34.

Further, as shown in FIGS. 2 to 5, a plurality of recesses 14*a*, each of which has a rectangular planar shape, are formed at portions of the nozzle plate 14 opposed to the plurality of individual electrodes 32. Therefore, when the driving voltage is applied to the individual electrode 32 to deform the piezoelectric layer 31, then the deformation of the piezoelectric layer 31 is not inhibited by the nozzle plate 14 and the adhesive 22 for adhering the nozzle plate 14 and the piezoelectric layer 31, and thus the driving efficiency of the piezoelectric actuator 3 is improved. The recesses 14*a* are not formed commonly to extend over the plurality of individual electrodes 32. As shown in FIG. 2, the plurality of recesses 14*a* are individually formed for the plurality of individual electrodes 32 respectively. Therefore, the rigidity of the nozzle plate 14 is secured to some extent by the portions which are disposed between the recesses 14*a*. Accordingly, it is possible to avoid the flexible bending of the nozzle plate 14, for example, when the ink-jetting surface (lower surface of the nozzle plate 14) is wiped with a wiper or the like after the purge operation (bubble discharge operation) from the nozzles 20. Further, as shown in FIG. 2, the plurality of wiring sections 34 are formed in the areas between the plurality of recesses 14*a*, i.e., in the areas in which the plurality of wiring sections 34 are not opposed to the plurality of nozzles 20 and the plurality of pressure chambers 16. Therefore, the conductive ink is not adhered to the wiring sections 34. It is possible to avoid any short circuit which would be otherwise formed between the wiring sections 34. When the driving voltage is applied to the individual electrode 32, the wiring section 34 does not inhibit the deformation of the piezoelectric layer 31 as well.

Figure 8A:
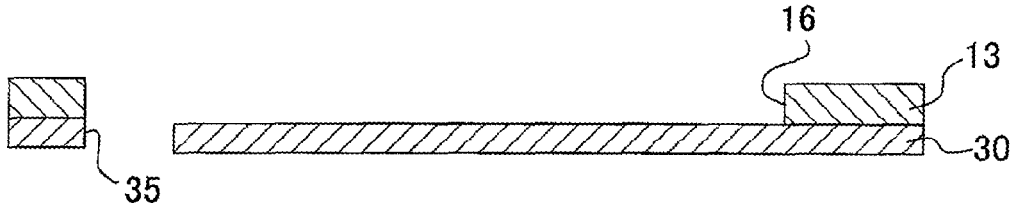
FIG. 8A shows a joining step of joining a pressure chamber plate and a vibration plate.

Next, an explanation will be made about a method for producing the ink-jet head 1 described above. At first, an explanation will be made with reference to FIG. 8 about steps of stacking a plurality of plates (including the vibration plate 30 and the piezoelectric layer 31 of the piezoelectric actuator 3) other than the nozzle plate 14. At first, as shown in FIG. 8A, the through-holes 35, which constitute parts of the individual ink flow passages 2, are formed through the vibration plate 30, for example, by means of the etching (a hole-forming step). The pressure chamber plate 13, in which the pressure chambers 16 are formed, is joined to the vibration plate 30 by means of the metal diffusion bonding or the adhesive.

Figure 8B:
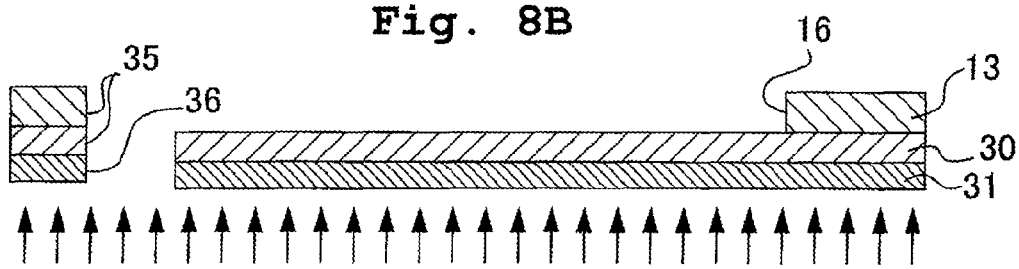
FIG. 8B shows a piezoelectric layer-forming step.

Subsequently, as shown in FIG. 8B, particles of the piezoelectric element are deposited on the surface of the vibration plate 30 disposed on the side opposite to the pressure chamber plate 13, and the heat treatment is applied. Accordingly, the piezoelectric layer 31 is formed in only the area of the vibration plate 30 in which the through-holes 35 are not formed (a piezoelectric layer-forming step). The following method is available to deposit the piezoelectric element on the vibration plate 30. That is, the piezoelectric element can be formed by using, for example, the aerosol deposition method (AD method) in which a superfine particle material is collided and deposited at a high speed. Alternatively, it is also possible to use the sputtering method and the CVD (chemical vapor deposition) method. When the piezoelectric layer 31 is formed by depositing the piezoelectric element particles on the vibration plate 30, the through-holes 36, which constitute parts of the individual ink flow passages 2 in the same manner as the through-holes 35, are simultaneously formed at the positions of the piezoelectric layer 31 corresponding to the through-holes 35 of the vibration plate 30.

Figure 8C:
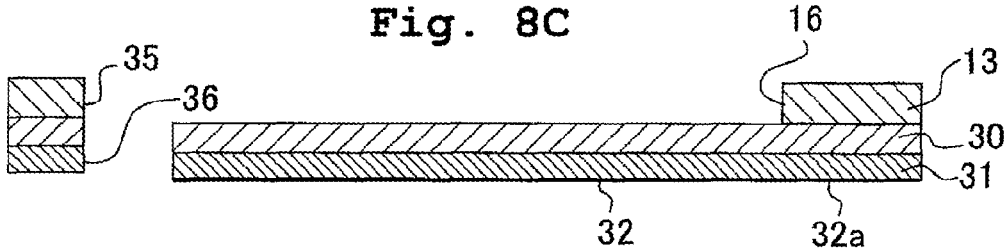
FIG. 8C shows an individual electrode-forming step.
Figure 8D:
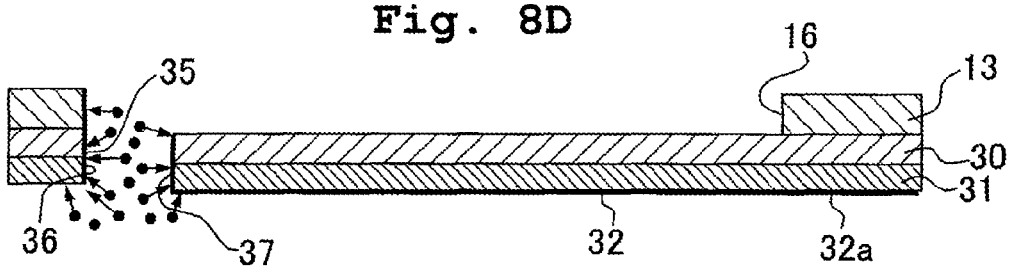
FIG. 8D shows a protective film-forming step.
Figure 8E:
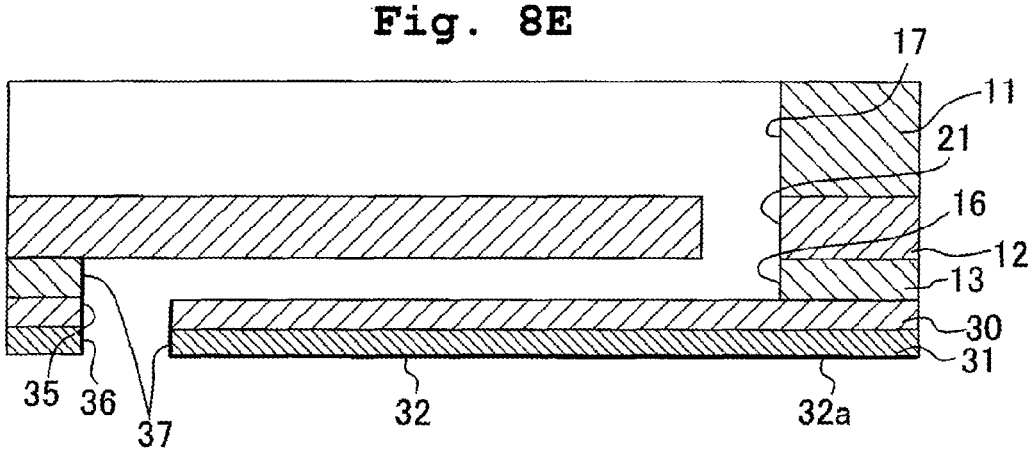
FIG. 8E shows a joining step of joining a manifold plate and a base plate.

As shown in FIG. 8C, the individual electrodes 32 are formed by using the screen printing or the vapor deposition method in the area opposed to the pressure chambers 16 on the surface of the piezoelectric layer 31 disposed on the side opposite to the vibration plate 30. Further, the contact sections 32*a*, which are continued to the individual electrodes 32, are formed. Further, as shown in FIG. 8D, the protective films 37, which prevent the ink from being permeated into the piezoelectric layer 31, are formed by using the AD method, the sputtering method, or the CVD method on the surfaces which define the through-holes 35, 36 formed through the vibration plate 30 and the piezoelectric layer 31 (a protective film-forming step). The base plate 12 and the two manifold plates 10, 11 are joined to the surface of the pressure chamber plate 13 disposed on the side opposite to the piezoelectric actuator 3. Alternatively, the five plates made of metal, i.e., the two manifold plates 10, 11, the base plate 12, the pressure chamber plate 13, and the vibration plate 30 may be previously joined at once by means of, for example, the diffusion bonding, and then the piezoelectric layer 31 may be formed on the surface of the vibration plate 30 disposed on the side opposite to the pressure chambers 16.

Figure 9A:
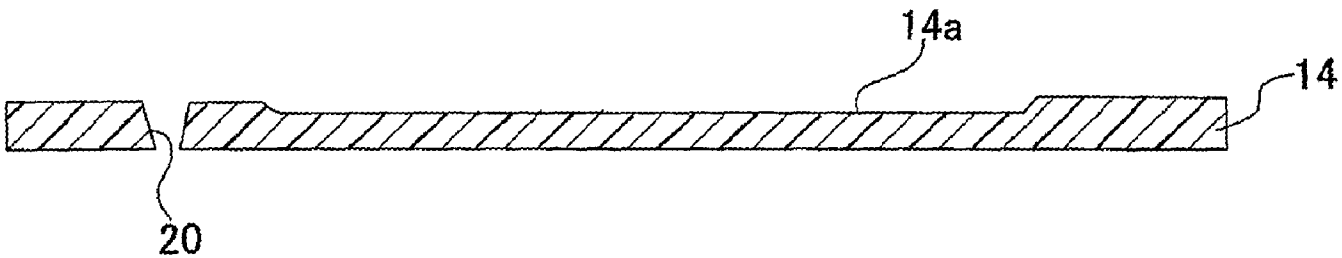
FIG. 9A shows a step of forming nozzles and recesses.
Figure 9B:
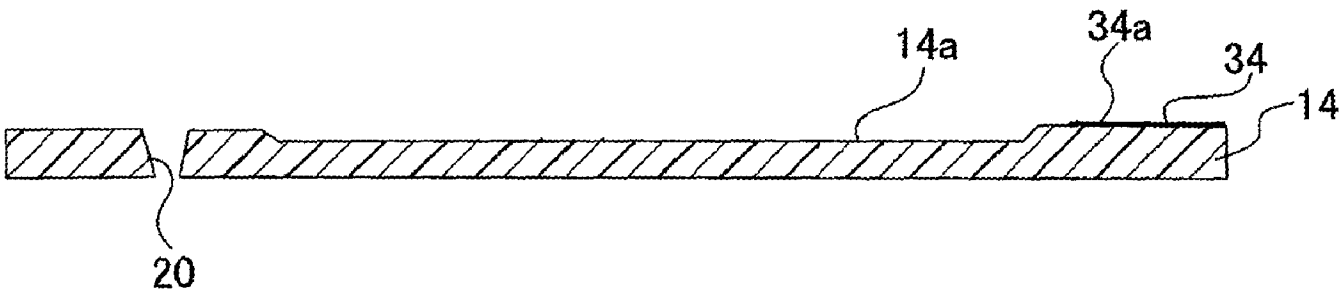
FIG. 9B shows a step of forming wiring sections.
Figure 9C:
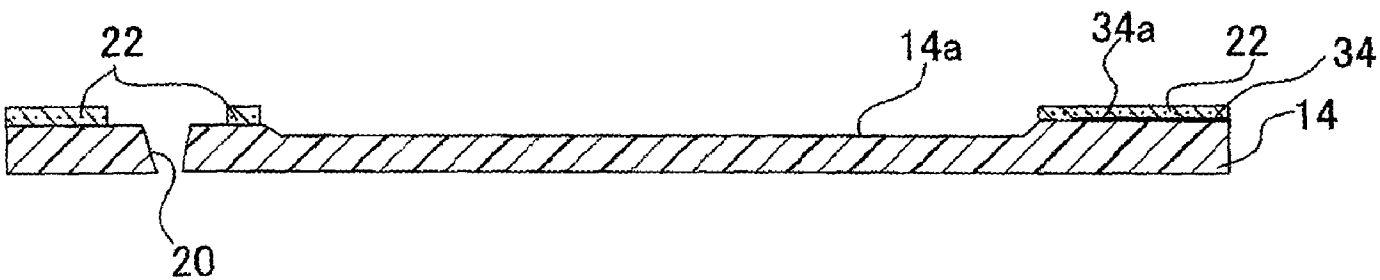
FIG. 9C shows a step of sticking an adhesive.

Next, an explanation will be made with reference to FIG. 9 about steps of forming the nozzle plate 14. As shown in FIG. 9A, the plurality of recesses 14*a* are formed in the areas to be opposed to the plurality of individual electrodes 32 respectively when the nozzle plate 14 is adhered to the piezoelectric layer 31. Further, the plurality of nozzles 20 are formed by means of, for example, the excimer laser processing. Subsequently, as shown in FIG. 9B, the wiring sections 34 (and the terminal sections 34*a*), which extend in the rightward direction, are formed on the portions disposed on the right side from the recesses 14*a*. As shown in FIG. 9C, the adhesive 22, which is composed of the anisotropic conductive material, is stuck by means of, for example, the screen printing onto the upper surface of the nozzle plate 14 to be adhered to the piezoelectric layer 31 (a sticking step). In the sticking step, the adhesive 22 may be stuck by effecting the patterning to only the portions of the nozzle plate 14 to be adhered to the piezoelectric layer 31. However, the adhesive 22 may be stuck to the entire surface of the nozzle plate 14. Also in this case, the deformation of the piezoelectric layer 31, which is brought about when the driving voltage is applied to the individual electrode 32, is not inhibited by the nozzle plate 14 and the adhesive 22 stuck to the nozzle plate 14, because the recesses 14*a* are formed at the portions of the nozzle plate 14 opposed to the individual electrodes 32.

Figure 10:
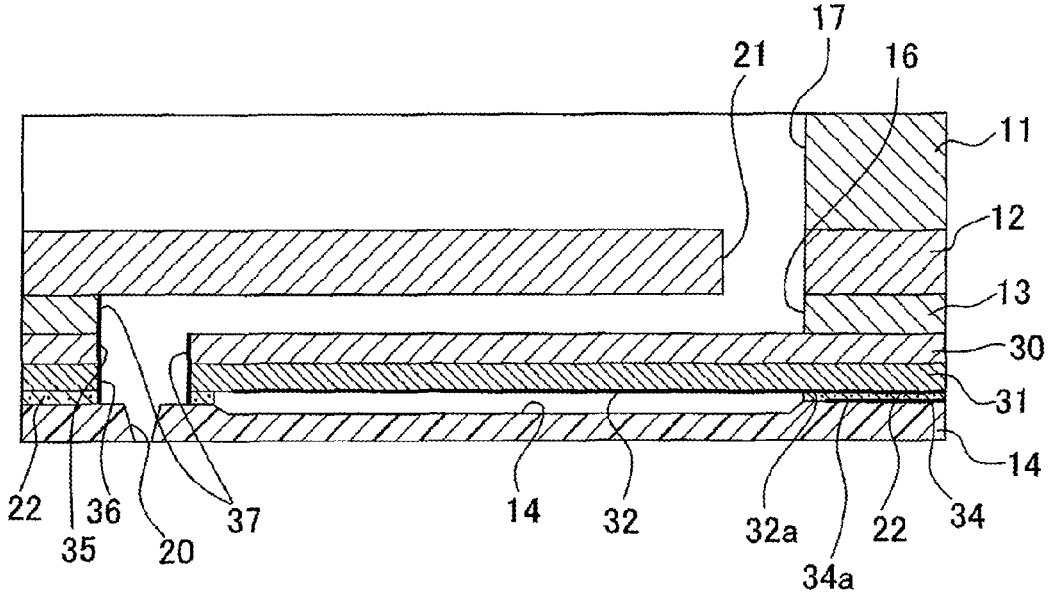
FIG. 10 shows a state in which the nozzle plate is adhered to the plurality of stacked plates other than the nozzle plate.

As shown in FIG. 10, the nozzle plate 14 is adhered by the adhesive 22 to the piezoelectric layer 31 of the piezoelectric actuator 3 (an adhering step). In this procedure, the contact sections 32*a* of the individual electrodes 32 are allowed to make contact with the adhesive 22 stuck to the surfaces of the terminal sections 34*a* of the wiring sections 34. The adhesive 22 of these portions is compressed to connect the individual electrodes 32 and the wiring sections 34 in the conducting state, and the other portions of the wiring sections 34 are adhered to the piezoelectric layer 31 in the insulating state by means of the adhesive 22 which is not compressed. Simultaneously, the adhesive 22, which is stuck to the portions of the nozzle plate 14 other than the wiring sections 34, is used to adhere the nozzle plate 14 and the piezoelectric layer 31. Each of the individual electrode 32 and the wiring section 34 has a thickness of about 5 μm. Therefore, the spacing distance (D1 as shown in FIG. 5) between the contact sections 32*a* of the individual electrodes 32 and the terminal sections 34*a* of the wiring sections 34 formed on the nozzle plate 14 is smaller than the spacing distance (D2 as shown in FIG. 5) between the nozzle plate 14 and the piezoelectric layer 31 at the portions other than the above. Therefore, when the nozzle plate 14 is adhered to the piezoelectric layer 31 of the piezoelectric actuator 3, only the adhesive 22, which is disposed between the contact sections 32*a* of the individual electrodes 32 and the terminal sections 34*a* of the wiring sections 34, can be compressed by merely pressing the nozzle plate 14 against the piezoelectric layer 31 uniformly. It is easy to electrically connect the individual electrodes 32 and the wiring sections 34.

Alternatively, the thickness of the portions around the nozzles 20 (left end portion of the nozzle plate 14 as shown in FIG. 9) may be made slightly thinner than the thickness of the portions at which the wiring sections 34 are formed (right end portion of the nozzle plate 14 as shown in FIG. 9). Accordingly, the spacing distance (D1 as shown in FIG. 5) between the contact sections 32*a* of the individual electrodes 32 and the terminal sections 34*a* of the wiring sections 34 formed on the nozzle plate 14 may be made smaller than the spacing distance (D2 as shown in FIG. 5) between the nozzle plate 14 and the piezoelectric layer 31 at the portions other than the above.

According to the ink-jet head 1 and the method for producing the same as explained above, the following effect is obtained. The plurality of wiring sections 34 for connecting the plurality of individual electrodes 32 of the piezoelectric actuator 3 and the driver IC 38 for supplying the driving voltage to the plurality of individual electrodes 32 are formed on the nozzle plate 14 composed of the insulating material. The nozzle plate 14 can be allowed to have the function of the wiring member such as FPC to dispense with the wiring member. Therefore, it is possible to decrease the number of parts, and it is possible to reduce the production cost of the ink-jet head 1. Additionally, the driver IC 38 can be arranged on the nozzle plate 14. Further, the nozzle plate 14 can be subjected to the flexible arrangement in the same manner as FPC or the like, because the nozzle plate 14 has the flexibility. The degree of freedom of the arrangement of the driver IC 38 is enhanced. Furthermore, the nozzle plate 14 can be adhered to the piezoelectric actuator 3, simultaneously with which the plurality of individual electrodes 32 and the plurality of wiring sections 34 can be electrically connected to one another. It is possible to simplify the production steps for producing the ink-jet head 1.

The piezoelectric layer 31 and the nozzle plate 14 are adhered by the adhesive 22 composed of the anisotropic conductive material in the step of adhering the nozzle plate 14 and the piezoelectric layer 31 of the piezoelectric actuator 3. Therefore, the electric connection between the individual electrodes 32 and the wiring sections 34 can be performed at once by using the one type of the adhesive 22. It is possible to further simplify the production steps, and it is possible to reduce the production cost. Further, the adhesive 22, which is disposed between the individual electrodes 32 and the wiring sections 34, is compressed to have the conductivity, but the adhesive 22, which is disposed at the other portions, is not compressed to have the insulating property. Therefore, it is possible to suppress the generation of any unnecessary capacitance in the piezoelectric layer 31 interposed between the wiring sections 34 and the vibration plate 30 at the portions other than the electric connecting portions between the individual electrodes 32 and the wiring sections 34. Thus, the driving efficiency of the piezoelectric actuator 3 is improved.

Next, an explanation will be made about modified embodiments in which the embodiment described above is variously changed. However, those having the same construction as that of the embodiment described above are designated by the same reference numerals, any explanation of which will be appropriately omitted.

First Modified Embodiment

Figure 11:
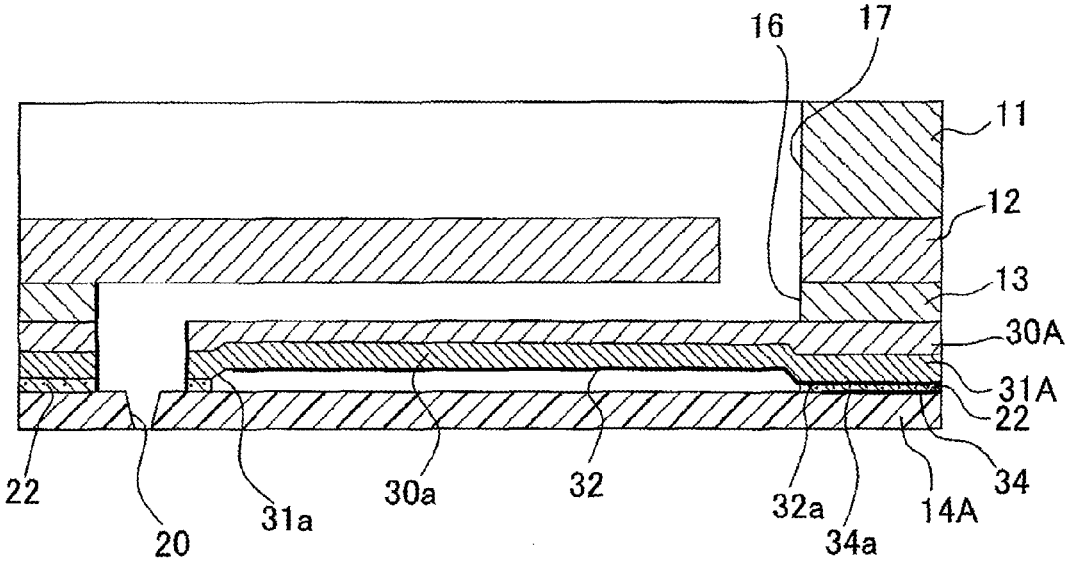
FIG. 11 shows a sectional view illustrating a first modified embodiment, corresponding to FIG. 5.

In the embodiment described above, the recesses are formed at the portions of the nozzle plate opposed to the individual electrodes 32. However, recesses may be formed on the side of the piezoelectric layer. For example, as shown in FIG. 11, a plurality of recesses 30*a* may be formed at portions of a vibration plate 30A opposed to the plurality of individual electrodes 32 respectively, and recesses 31*a*, which correspond to the recesses 30*a* of the vibration plate 30A, may be formed on a piezoelectric layer 31A. In this arrangement, the piezoelectric layer 31A is formed to have a uniform thickness by means of, for example, the AD method or the CVD method on the surface of the vibration plate 30A formed with the recesses 30*a*. Accordingly, the recesses 31*a* of the piezoelectric layer 31A can be simultaneously formed. In this procedure, the adhesive 22 is stuck to the piezoelectric layer 31A, and then the nozzle plate 14A is adhered to the piezoelectric layer 31A.

Second Modified Embodiment

Figure 12:
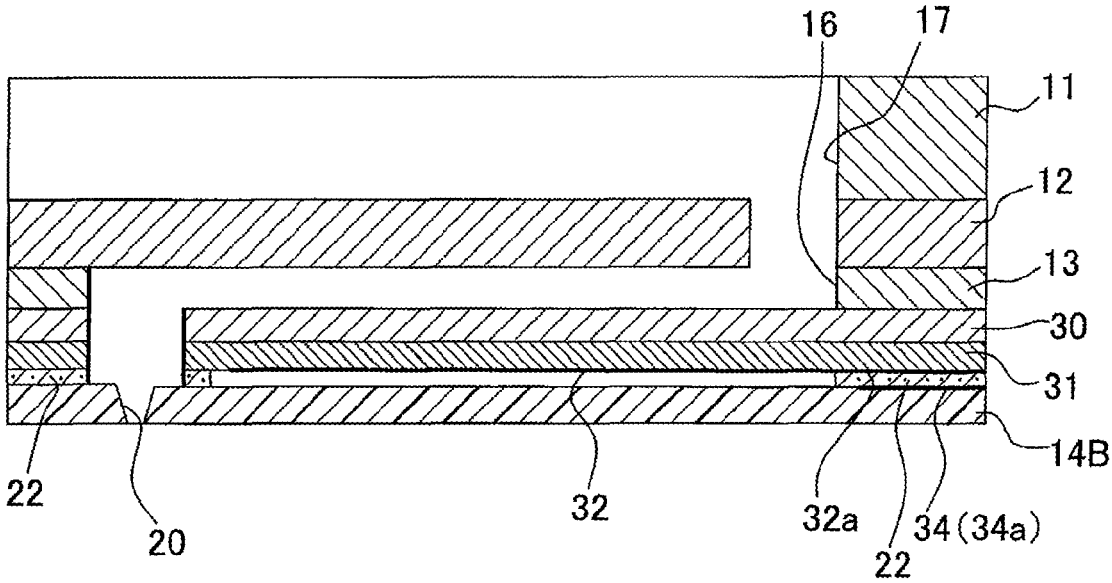
FIG. 12 shows a sectional view illustrating a second modified embodiment, corresponding to FIG. 5.

When the adhesive 22 is stuck by effecting the patterning in the sticking step of sticking the adhesive 22 to the nozzle plate 14 (or the piezoelectric layer 31), the gap is formed by the adhesive 22 between the nozzle plate 14 and the piezoelectric layer 31. Owing to the gap, the deformation of the piezoelectric layer 31 is hardly inhibited by the nozzle plate 14 and the adhesive 22 stuck to the nozzle plate 14. Therefore, as shown in FIG. 12, it is also allowable to omit the recesses of the nozzle plate 14B (or the piezoelectric layer 31). In order to stick the adhesive 22 by effecting the patterning, the following procedure can be also adopted other than the screen printing as described above. That is, the adhesive 22 is stuck to the entire surface of the nozzle plate 14 (14B), and then the adhesive 22, which is disposed at portions at which no adhesion is effected with respect to the piezoelectric layer 31, is partially removed by means of, for example, the laser.

Third Modified Embodiment

The electric connection between the contact sections 32*a* of the individual electrodes 32 formed on the piezoelectric layer 31 and the terminal sections 34*a* of the wiring sections 34 formed on the nozzle plate 14, and the adhesion of the piezoelectric layer 31 and the nozzle plate 14 at the portions other than the electric connecting portions can be also performed by using distinct adhesive materials. For example, a conductive paste may be used for the electric connection between the individual electrodes 32 and the wiring sections 34, and a non-conductive adhesive may be used for the adhesion of the piezoelectric layer 31 and the nozzle plate 14 at the other portions. However, in this case, it is preferable that the conductive paste and the non-conductive adhesive, which have their curing temperatures close to one another, are used in order to simultaneously perform the electric connection between the individual electrodes 32 and the wiring section 34 and the adhesion of the piezoelectric layer 31 and the nozzle plate 14.

Fourth Modified Embodiment

The following procedure is also available. That is, a nozzle plate is formed with a metal material such as stainless steel. A thin film of an insulating material such as alumina is formed on one surface of the metal plate by means of, for example, the AD method, the sputtering method, or the CVD method. Accordingly, the nozzle plate is allowed to have an insulating property on the surface on which the thin film is formed. In this case, the surface of the nozzle plate, on which the thin film is formed, may be used as the surface which is opposed to the piezoelectric actuator 3 and on which the plurality of wiring sections 34 are formed.

Fifth Modified Embodiment

Figure 13:
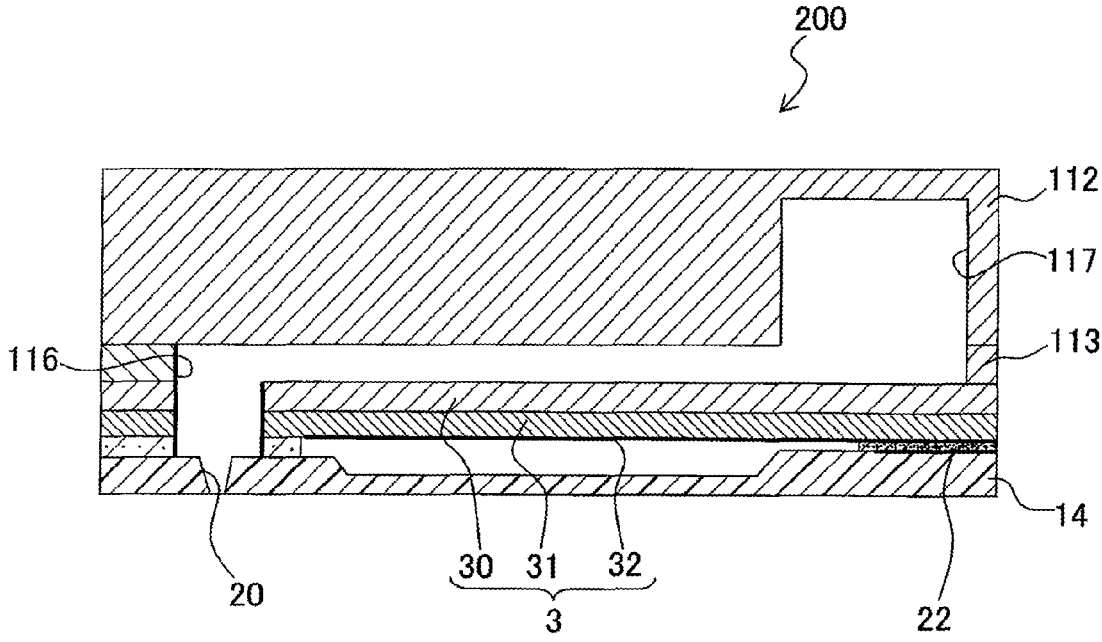
FIG. 13 shows an ink-jet head having a manifold arranged adjacently to pressure chambers, corresponding to FIG. 5.

In the embodiment described above, the manifold is formed at the upper position of the base plate, and the pressure chambers are formed at the lower positions of the base plate. However, the position of the manifold is not limited to the position over the pressure chambers. A part of the manifold may be formed at the same level (height) as that of the pressure chambers. For example, the lower surfaces of the pressure chambers may have the same level as that of the lower surface of the manifold. An ink-jet head 200 shown in FIG. 13 comprises a manifold plate 112 in which a manifold 117 is formed, a pressure chamber plate 113 in which pressure chambers 116 are formed, the piezoelectric actuator 3 which has the vibration plate 30 and the piezoelectric layer 31, the anisotropic conductive layer 22, and the nozzle plate 14. The manifold plate 112 is joined to the surface of the piezoelectric actuator 3 on the side of the vibration plate 30 with the pressure chamber plate 113 intervening therebetween. The nozzle plate 14 is joined to the surface of the piezoelectric actuator 3 on the side of the piezoelectric layer 31 with the anisotropic conductive layer 22 intervening therebetween. In this arrangement, the vibration plate 30 defines the lower surfaces of the pressure chambers 116, and the vibration plate 30 also defines the lower surface of the manifold 117. That is, the lower surfaces of the pressure chambers 116 are formed to have the same level as that of the lower surface of the manifold 117. When a part of the manifold is formed to have the same level as that of the pressure chambers as described above, it is possible to thin the thickness of the ink-jet head.

The embodiment described above is illustrative of the case in which the present invention is applied to the ink-jet head for jetting the ink. However, the present invention is also applicable to other liquid-jetting apparatuses for jetting liquids other than the ink. The present invention is also applicable to various liquid-jetting apparatuses to be used, for example, when an organic light-emitting material is jetted onto a substrate to form an organic electroluminescence display, and when an optical resin is jetted onto a substrate to form an optical device such as an optical waveguide.

What is claimed is:

1. A liquid-jetting apparatus comprising:

a plurality of liquid flow passages which include a plurality of nozzles for jetting a liquid and a plurality of pressure chambers communicating with the plurality of nozzles respectively;

an actuator which selectively changes volumes of the plurality of pressure chambers, wherein:

the liquid flow passages are formed by a plurality of stacked plates, the actuator is arranged between a pressure chamber plate which is included in the plurality of plates and which forms the plurality of pressure chambers and a nozzle plate which has an insulating property at least on a surface opposed to the pressure chamber plate and which is formed with the nozzles, and the actuator includes a vibration plate which covers the plurality of pressure chambers, a piezoelectric layer which is provided on a surface of the vibration plate disposed on a side not facing the plurality of pressure chambers, and a plurality of individual electrodes which are formed at positions opposed to the plurality of pressure chambers respectively on a surface of the piezoelectric layer disposed on a side not facing the vibration plate;

a plurality of wiring sections, which are connected to the plurality of individual electrodes respectively, are formed on the surface of the nozzle plate and disposed on a side of the actuator, wherein the nozzle plate has an extended portion on which a portion of the wiring sections is directly formed, the extended portion being provided so as to not overlap with the pressure chamber plate in a stacking direction of the plurality of stacked plates.

2. The liquid-jetting apparatus according to claim 1, wherein a driver IC is provided on the extended portion.

3. The liquid-jetting apparatus according to claim 1, wherein the wiring sections are arranged on the nozzle plate on a side not facing a liquid-jetting surface of the nozzle plate.

4. A liquid-jetting apparatus comprising:

a plurality of liquid flow passages which include a plurality of nozzles for jetting a liquid and a plurality of pressure chambers communicating with the plurality of nozzles respectively;

an actuator which selectively changes volumes of the plurality of pressure chambers, wherein:

the liquid flow passages are formed by a plurality of stacked plates, the actuator is arranged between a pressure chamber plate which is included in the plurality of plates and which forms the plurality of pressure chambers and a nozzle plate which has an insulating property at least on a surface opposed to the pressure chamber plate and which is formed with the nozzles, and the actuator includes a vibration plate which covers the plurality of pressure chambers, a piezoelectric layer which is provided on a surface of the vibration plate disposed on a side not facing the plurality of pressure chambers, and a plurality of individual electrodes which are formed at positions opposed to the plurality of pressure chambers respectively on a surface of the piezoelectric layer disposed on a side not facing the vibration plate;

a plurality of wiring sections, which are connected to the plurality of individual electrodes respectively, are formed on the surface of the nozzle plate and disposed on a side of the actuator, wherein the wiring sections are arranged on the nozzle plate on a side not facing a liquid-jetting surface of the nozzle plate, and wherein portions of the wiring sections, to which the individual electrodes are connected and which overlap the individual electrodes in a stacking direction of the plurality of stacked plates, are in close contact with the nozzle plate, and do not overlap with the pressure chambers in the stacking direction of the plurality of stacked plates.

5. The liquid-jetting apparatus according to claim 1, wherein the plurality of wiring sections do not form a flexible printed circuit.

6. The liquid-jetting apparatus according to claim 1, wherein portions of the wiring sections, to which the individual electrodes are connected and which overlap the individual electrodes in a stacking direction of the plurality of stacked plates, do not overlap with the pressure chambers in the stacking direction of the plurality of stacked plates.

* * * * *